US008585048B2

(12) United States Patent
Yamagishi et al.

(10) Patent No.: US 8,585,048 B2
(45) Date of Patent: Nov. 19, 2013

(54) PRINTING DEVICE

(75) Inventors: Ryota Yamagishi, Ibaraki-ken (JP); Masahiko Kusuhata, Ibaraki-ken (JP); Masashi Hara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/332,607

(22) Filed: Dec. 21, 2011

(65) Prior Publication Data

US 2012/0161388 A1 Jun. 28, 2012

(30) Foreign Application Priority Data

Dec. 22, 2010 (JP) ..... P2010-285474

(51) Int. Cl.
*B65H 9/04* (2006.01)

(52) U.S. Cl.
USPC ..... 271/245; 271/186; 399/364

(58) Field of Classification Search
USPC ..... 271/245, 246, 291, 301, 65, 186; 399/364
See application file for complete search history.

(56) References Cited

U.S. PATENT DOCUMENTS 5,905,934 A * 5/1999 Koshimizu ..... 399/396
2006/0202407 A1 * 9/2006 Yasui et al. ..... 271/226

FOREIGN PATENT DOCUMENTS

JP 6-24588 A 2/1994

* cited by examiner

*Primary Examiner* — Michael McCullough
(74) *Attorney, Agent, or Firm* — Nath, Goldberg & Meyer; Jerald L. Meyer

(57) ABSTRACT

A printing device includes: a registration roller that once stops a transferred sheet and then feeds the transferred sheet toward an inkjet head unit; a sheet feed system that transfers and feeds a sheet to the registration roller; a sheet refeed system that, during both-side printing, reverses a one-side printed sheet and transfers the one-side printed sheet to the registration roller; and a controller that, during both-side printing, controls the registration roller so as to feed a sheet, which is fed by the sheet feed system and the sheet refeed system, toward the inkjet head unit in accordance with a predetermined print schedule. The controller controls the sheet feed system in accordance with the print schedule so that a speed when a sheet fed from the sheet feed system is abutted against the inkjet head unit becomes lower during both-side printing than during one-side printing.

4 Claims, 5 Drawing Sheets

PRINTING DEVICE

BACKGROUND OF THE INVENTION

1. Technical Field

The present invention relates to printing devices that perform printing onto a sheet and the like, and in particular relates to a technique to reduce the noise generated by the printing devices.

2. Background Arts

There is conventionally known printing device having a feeding mechanism, in which a sheet extracted from a sheet feed stand is fed toward a printing section including an inkjet head and the like by a registration roller.

In this printing device, a sheet is abutted against the registration roller and stopped once so as to form sag in the sheet, and then an oblique motion of the sheet is corrected. Then, the printing device drives the registration roller at a predetermined timing to feed the sheet to the printing section.

When a sheet is abutted against the registration roller, a hitting sound is generated. In addition, when a sheet is fed by the registration roller and sag in the sheet is released, a sound of the sheet being pulled (sheet-pulling sound) may be generated. In particular, in a printing device achieving high productivity (the number of sheets to be printed per unit time) by high-speed printing, sheets are transferred at a high speed, and therefore the hitting sound and sheet-pulling sound become louder.

There is also known a both-side printing device having a circulation path including a reverse path for reversing a sheet, in which a one-side printed sheet is reversed by transferred through the circulation path and then the other side is printed.

In this printing device, since both-side printing makes use of sheet transfer paths more than one-side printing, transfer path switching operations are needed. In addition, in order to maintain high productivity, the sheet needs to be transferred partially at a higher speed. From these factors, the driving noise of a motor and the like becomes loud during both-side printing.

As described above, in a printing device, noise is generated due to various factors. As a technique to reduce the noise generated by a printing device, Japanese Patent Laid-Open No. 6-24588 discloses a technique, in which the transfer speed of a sheet is decelerated when the sheet is detected by a detector provided in the preceding stage of a registration roller, thereby reducing the sound caused by the sheet abutted against the registration roller.

SUMMARY OF THE INVENTION

However, in the technique of this Patent Document, although the hitting sound of a sheet against the registration roller can be reduced, the transfer speed is reduced for all the sheets transferred to the registration roller, thereby decreasing in productivity in the printing device.

The present invention has been made in light of the above-described circumstances to provide a printing device capable of reducing noise while maintaining productivity.

In order to achieve the above-described objective, a printing device according to one embodiment of the present invention comprises: a registration section that once stops a transferred sheet and then feeds the transferred sheet toward a printing section; a sheet feed system that transfers and feeds a sheet to the registration section; a sheet refeed system that, during both-side printing, reverses a one-side printed sheet and transfers the one-side printed sheet to the registration section to reefed the one-side printed sheet; and a controller that, during both-side printing, controls the registration section so as to feed a sheet, which is fed by the sheet feed system and the sheet refeed system, toward the printing section in accordance with a predetermined print schedule, wherein the controller controls the sheet feed system in accordance with the printing schedule so that a speed when a sheet fed from the sheet feed system is abutted against the registration section is lower during double-side printing than during one-side printing.

DESCRIPTION OF THE EMBODIMENTS

Figure 1:
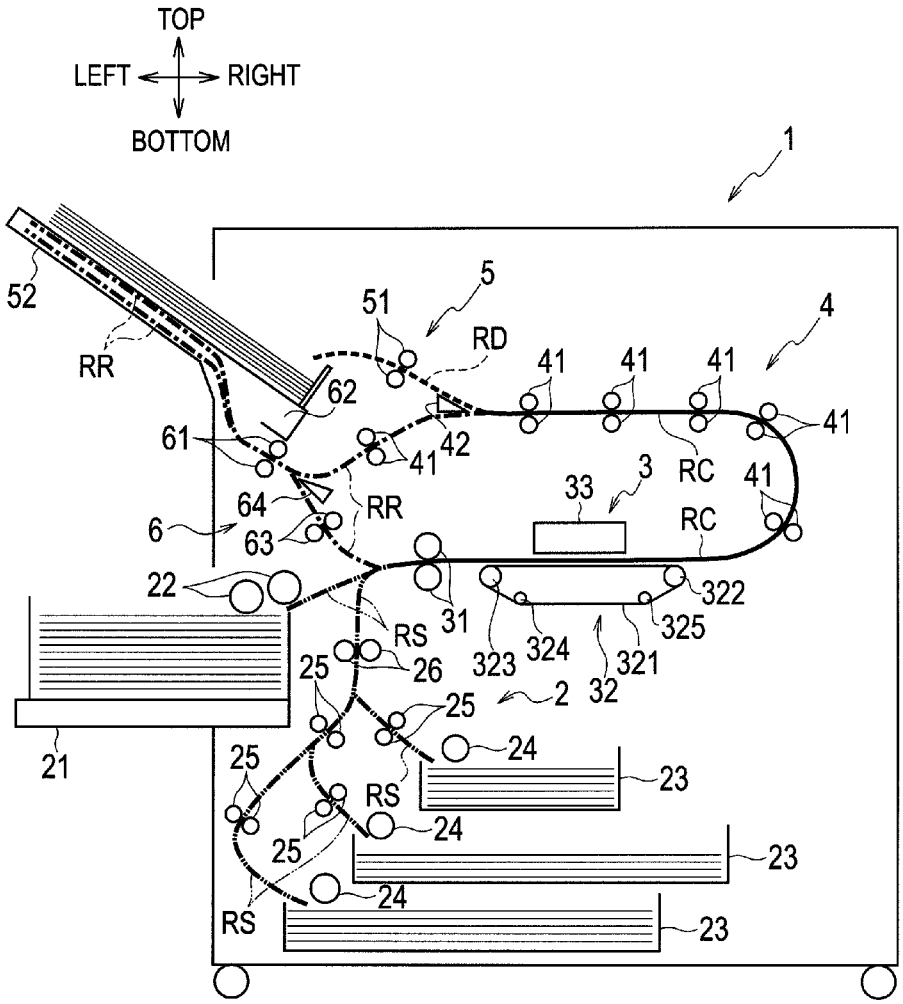
FIG. 1 is a schematic configuration diagram of a printing device according to one embodiment of the present invention.

An embodiment of the present invention will be described below with reference to the accompanying drawings. Throughout the respective drawings, the same or equivalent reference numerals are assigned to the same or equivalent components. Note that the embodiment described in the drawings is schematic only and different from the real one.

Moreover, this embodiment exemplifies a device and the like for embodying the technical thought of the present invention. However, the technical thought of the present invention shall not be construed as limiting the arrangement and the like of the respective components to the following ones. The technical thought of the present invention may be modified within the original scope of the present application.

<Configuration of the Printing Device>

Figure 2:
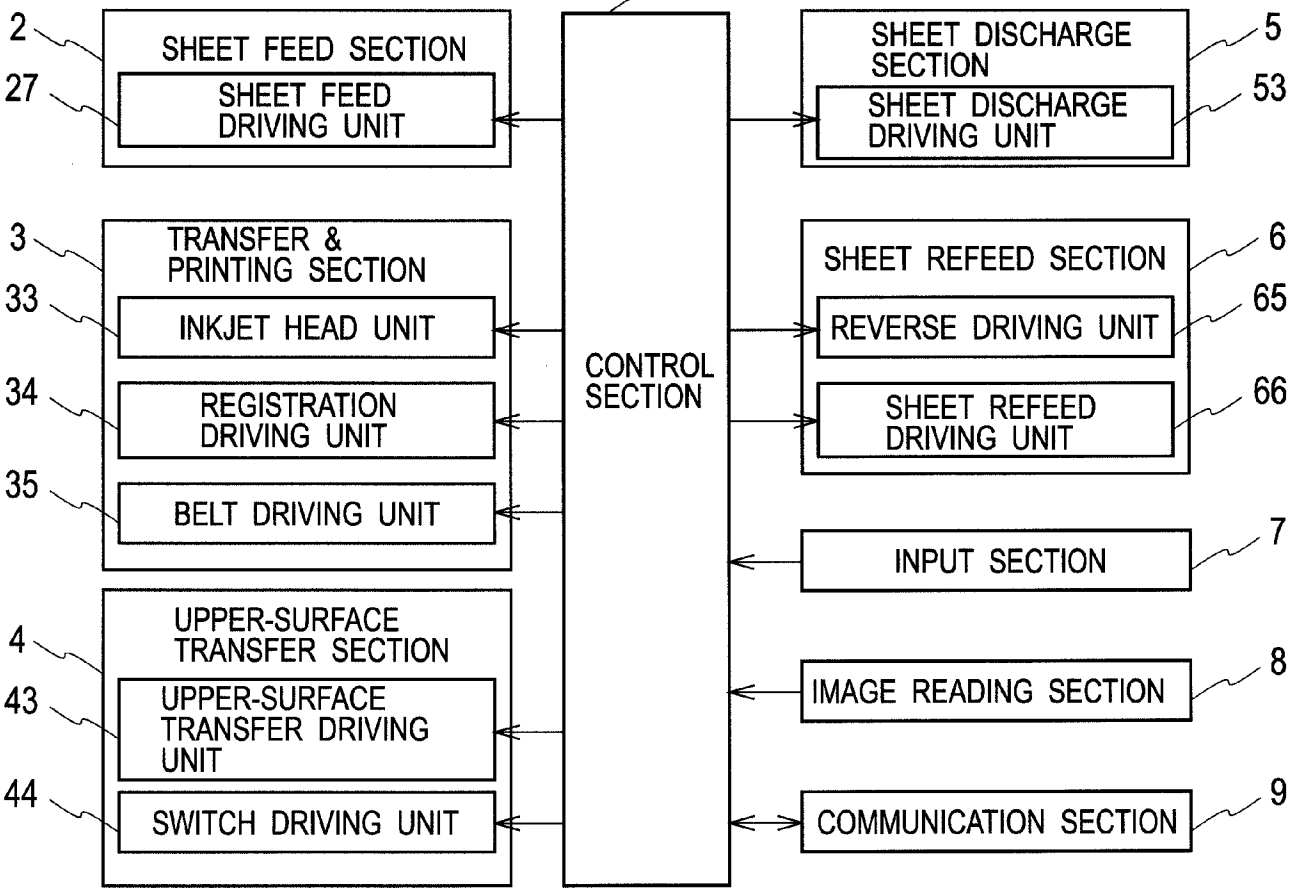
FIG. 2 is a block diagram showing the configuration of a control system of the printing device shown in FIG. 1.

FIG. 1 is a schematic configuration diagram of a printing device according to an embodiment of the present invention. FIG. 2 is a block diagram showing the configuration of a control system of the printing device shown in FIG. 1.

As shown in FIGS. 1 and 2, a printing device 1 includes a sheet feeder 2, a transferring and printing section 3, an upper-surface transferring section 4, a sheet discharge section 5, a sheet refeed section 6, an input section 7, an image reading section 8, a communication section 9, and a controller 10.

Note that paths indicated by a bold line in FIG. 1 are transfer paths through which a sheet as a print medium is transferred. Among the transfer paths, a path indicated by a solid line is a regular path RC, a path indicated by a one-dot chain line is a reverse path RR, a path indicated by a dot line is a sheet discharge path RD, and a path indicated by a two-dot chain line is a sheet feed path RS. The terms "upstream" and "downstream" will indicate below the upstream and the downstream in a transfer direction on the transfer paths, respectively. Moreover, the terms "vertical direction" and "horizontal direction" will indicate below the vertical direction and the horizontal direction shown in FIG. 1. Note that a sheet as the print medium is not limited to a paper but may be made of other materials such as synthetic resin.

The sheet feeder 2 transfers and feeds a sheet to the transferring and printing section 3. The sheet feeder 2 is provided on the most upstream side of the transfer paths. The sheet feeder 2 includes an external sheet feed stand 21, an external sheet feed roller 22, a plurality of internal sheet feed stands 23, a plurality of internal sheet feed rollers 24, a plurality of pairs of internal sheet feed and transfer rollers 25, a vertical transfer roller 26, and a sheet feed driving unit 27. The external sheet feed stand 21 and the internal sheet feed stand 23 are collectively referred to as a sheet feed stand in the embodiment.

The external sheet feed stand 21 is exposed and installed outside an enclosure of the printing device 1. Sheets used in printing are stacked in this stand.

The external sheet feed roller 22 extracts a sheet from the external sheet feed stand 21 one by one, and transfers and feeds the sheet toward a registration roller 31.

The internal sheet feed stand 23 is provided inside the enclosure of the printing device 1. Sheets used in printing are stacked in this stand.

The internal sheet feed roller 24 extracts a sheet from the internal sheet feed stand 23 one by one, and feeds the sheet to the sheet feed path RS.

The internal sheet feed and transfer roller 25 transfers a sheet, which is extracted from the internal sheet feed stand 23, along the sheet feed path RS.

The vertical transfer roller 26 transfers and feeds a sheet, which is transferred from either one of the internal sheet feed stands 23, toward the registration roller 31.

The sheet feed driving unit 27 drives the external sheet feed roller 22, the internal sheet feed roller 24, the internal sheet feed and transfer rollers 25, and the vertical transfer roller 26, respectively, under the control of the controller 10. The sheet feed driving unit 27 includes a motor and the like.

The transferring and printing section 3 prints an image onto a sheet while transferring a sheet. The transferring and printing section 3 is arranged on the downstream side of the sheet feeder 2. The transferring and printing section 3 includes the registration roller 31, a belt transfer unit 32, an inkjet head unit 33, a registration driving unit 34, and a belt driving unit 35.

The registration roller 31 once stops a sheet that is transferred by the sheet feeder 2 and the sheet refeed section 6, and then feeds it to the downstream belt transfer unit 32 at a predetermined timing. The sheet is abutted against the registration roller 31, and the sheet sags, whereby an oblique motion of the sheet is corrected. The registration roller 31 is arranged in an upstream portion of the transferring and printing section 3 and over the regular path RC. In other words, the registration roller 31 is arranged in the vicinity of the junction of the sheet feed path RS and the reverse path RR. The registration roller 31 is referred to a registration section in the embodiment.

The belt transfer unit 32 is provided on the downstream side of the registration roller 31. The belt transfer unit 32 includes a circular transfer belt 321 provided under the inkjet head unit 33, the circular transfer belt 321 facing the inkjet head unit 33, a belt driving roller 322 circumferentially driving the transfer belt 321, and driven rollers 323-325 following the belt driving roller 322. The transfer belt 321 includes an endless belt provided with a large number of holes. The transfer belt 321 sucks and holds a sheet with a negative pressure that is generated by air sucked from the holes by a non-illustrated suction fan, and transfers the same.

The inkjet head unit 33 is arranged above the belt transfer unit 32, and includes a plurality of inkjet heads of a line type, in which a plurality of nozzles is arranged in a direction perpendicular to a sheet transfer direction. The inkjet head unit 33 discharges ink from the inkjet head onto a sheet, which is transferred by the belt transfer unit 32, thereby printing an image. The inkjet head unit 33 is referred to as a printing section in the embodiment.

The registration driving unit 34 includes a motor and the like to rotatably drive the registration roller 31.

The belt driving unit 35 includes a motor and the like to rotatably drive the belt driving roller 322 of the belt transfer unit 32.

The upper-surface transferring section 4 transfers a sheet, which is transferred by the belt transfer unit 32, so that the sheet U-turns from the right to the left. The upper-surface transferring section 4 includes a plurality of pairs of upper surface transfer rollers 41, a switch unit 42, an upper surface transfer driving unit 43, and a switch driving unit 44.

The upper surface transfer roller 41 nips and transfers a sheet. The pairs of upper surface transfer rollers 41 are arranged along the regular path RC between the transferring and printing section 3 and the sheet discharge section 5. A pair of upper surface transfer rollers 41 is arranged in an upstream portion of the reverse path RR.

The switch unit 42 switches the transfer path of a sheet between the sheet discharge path RD connecting to the sheet discharge section 5 and the reverse path RR connecting to the sheet refeed section 6. The switch unit 42 is arranged at a branching point of the sheet discharge path RD and the reverse path RR.

The upper surface transfer driving unit 43 includes a motor and the like to rotatably drive each upper surface transfer roller 41.

The switch driving unit 44 includes a solenoid and the like to drive the switch unit 42.

The sheet discharge section 5 discharges and stacks the printed sheets. The sheet discharge section 5 includes a sheet discharge roller 51, a sheet discharge tray 52, and a sheet discharge driving unit 53.

The sheet discharge roller 51 conveys a sheet, which is transferred by the upper-surface transferring section 4, along the sheet discharge path RD, and discharges it to the sheet discharge tray 52. The sheet discharge roller 51 is arranged between the switch unit 42 and the sheet discharge tray 52.

The sheet discharge tray 52 is for stacking the sheets that are transferred by the sheet discharge roller 51. The sheet discharge tray 52 is arranged at a downstream end of the sheet discharge path RD. A part of the sheet discharge tray 52 projects from the enclosure of the printing device 1.

The sheet discharge driving unit 53 includes a motor and the like to rotatably drive the sheet discharge roller 51.

The sheet refeed section 6, in both-side printing, performs refeeding by reversing a one-side printed sheet and transferring it to the registration roller 31. The sheet refeed section 6 includes a reversing roller 61, a switchback unit 62, a sheet refeed roller 63, a switching gate 64, a reverse driving unit 65, and a sheet refeed driving unit 66.

The reversing roller 61 temporarily carries a sheet, which is transferred by the upper-surface transferring section 4, into the switchback unit 62, and then carries out and transfers it to the sheet refeed roller 63. The reversing roller 61 is arranged between the upper surface transfer roller 41 and a carrying-in entrance of the switchback unit 62 on the reverse path RR.

The switchback unit 62 is a space for the reversing roller 61 to temporarily carry in a sheet. The switchback unit 62 includes a space formed under the sheet discharge tray 52. The switchback unit 62 is opened for the vicinity of the reversing roller 61 to carry in a sheet.

The sheet refeed roller 63 transfers a sheet, which is transferred by the reversing roller 61, to the registration roller 31. The sheet refeed roller 63 is arranged over the reverse path RR between the reversing roller 61 and the registration roller 31.

The switching gate 64 guides a sheet, which is transferred by the upper surface transfer roller 41, to the reversing roller 61. Moreover, the switching gate 64 guides a sheet, which is carried out from the switchback unit 62 by the reversing roller 61, to the sheet refeed roller 63. The switching gate 64 is arranged in the vicinity of the center of gravity of three portions: the upper surface transfer roller 41 on the most downstream side; the reversing roller 61; and the sheet refeed roller 63.

The reverse driving unit 65 includes a motor and the like to rotatably drive the reversing roller 61.

The sheet refeed driving unit 66 includes a motor and the like to rotatably drive the sheet refeed roller 63.

The input section 7 includes various operation buttons, a touch panel (both not shown), and the like, and accepts an input operation performed by a user, and outputs an operation signal according to the operation.

The image reading section 8 optically reads the image of a document to generate print data, and output the same.

The communication section 9 processes the communication with external devices such as a PC (personal computer). The communication section 9 receives print data from an external device.

The controller 10 controls each section of the printing device 1. The controller 10 includes a CPU, a memory, and the like.

The controller 10, during both-side printing, performs print scheduling, and performs both-side printing according to this print schedule. The print schedule during both-side printing will be described later. The controller 10 controls so that the speed when a sheet fed from the sheet feeder 2 is abutted against the registration roller 31 becomes lower during both-side printing than during one-side printing.

<Operation of the Printing Device>

Next, the operation of the printing device 1 is explained.

Figure 3:
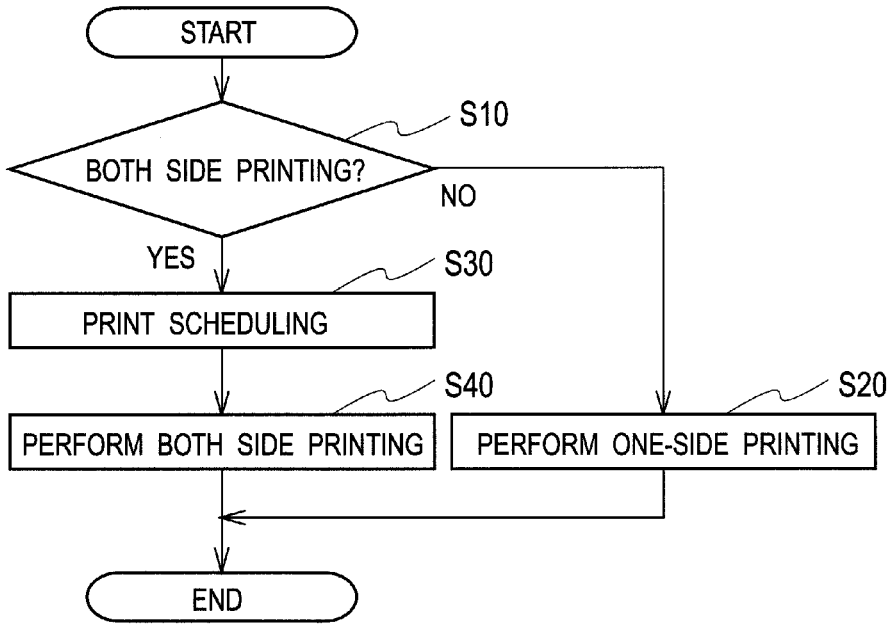
FIG. 3 is a flowchart for explaining an operation of the printing device shown in FIG. 1.

FIG. 3 is a flowchart for explaining an operation of the printing device 1. Assume here that a sheet is fed from the external sheet feed stand 21.

This flowchart is started when print data is input from an external device such as PC, or when a user instructs to print an image, which is read by the image reading section 8, through an operation of the input section 7. The user can set one-side printing or both-side printing through an operation for an external device or the input section 7.

In Step S10, the controller 10 determines whether or not the setting is for both-side printing. If it is determined that the setting is not for both-side printing, that is, the setting is for one-side printing (Step S10: NO), then in Step S20 the controller 10 controls each section so as to perform one-side printing.

In one-side printing, the controller 10 causes the sheet feed driving unit 27 to rotatably drive the external sheet feed roller 22, first. Thus, a sheet on the external sheet feed stand 21 is extracted and transferred through the sheet feed path RS, and a tip of the sheet is abutted against the registration roller 31. The controller 10 controls the sheet feed driving unit 27 so as to stop the external sheet feed roller 22 when a desired amount of sag is formed in the sheet abutted against the registration roller 31.

After stopping the external sheet feed roller 22, the controller 10 controls the registration driving unit 34 so as to start the driving of the registration roller 31 at a predetermined timing. Thus, the registration roller 31 rotates and the sheet is fed toward the belt transfer unit 32.

Figure 4:
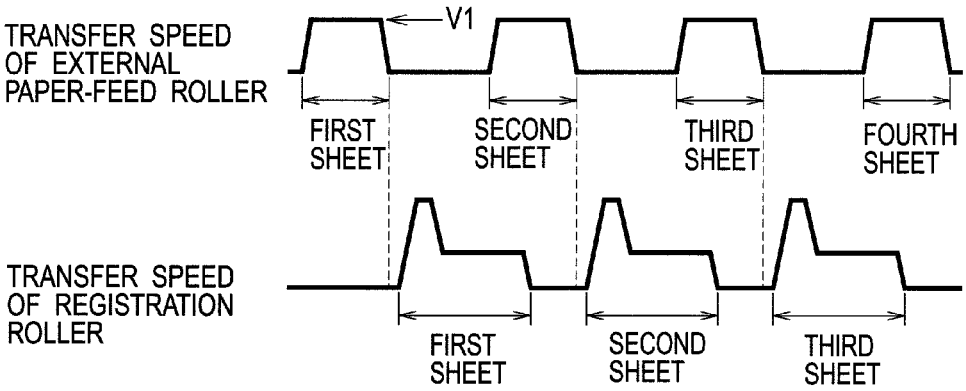
FIG. 4 is a view showing an example of a timing chart showing the transition of a transfer speed in an external sheet feed roller and a registration roller during one-side printing.

FIG. 4 is a view showing an example of a timing chart showing the transition of the transfer speed in the external sheet feed roller 22 and the registration roller 31 during one-side printing. The controller 10, as shown in FIG. 4, controls so as to intermittently drive the external sheet feed roller 22 and the registration roller 31 at a predetermined timing for each one sheet, and repeat this the number of times corresponding to the number of sheets to be printed. Here, the external sheet feed roller 22 is accelerated to a transfer speed V1, and then it is decelerated and stopped. Here a sheet is abutted against the registration roller 31 while the external sheet feed roller 22 is being driven at the transfer speed V1.

The controller 10 causes the inkjet head unit 33 to print an image onto a sheet while causing the belt transfer unit 32 to transfer a sheet, which is fed from the registration roller 31, at a predetermined speed. Then the controller 10 causes the upper surface transfer roller 41 to transfer the printed sheet through the regular path RC, and causes the switch unit 42 to guide the printed sheet to the sheet discharge path RD to cause the sheet discharge roller 51 to discharge the sheet to the sheet discharge tray 52.

On the other hand, in Step S10, if it is determined that the setting is for both-side printing (Step S10: YES), then in Step S30 the controller 10 performs print scheduling.

Here the print schedule during both-side printing is explained with reference to FIGS. 5A to 5D.

In FIGS. 5A to 5D, a number N written on a sheet P (N=1, 2, . . . ) indicates the order of sheet feed. Moreover, the front-side printing of the Nth sheet is indicated by a character "N" on the white-ground sheet P, and the back-side print of the Nth sheet is indicated by the character "N" on the dot-hatched sheet P. Note that the side to be printed first is referred to as the "front side" and the side to be printed later is referred to as the "back side."

Figures 5A, 5B, 5C, 5D:
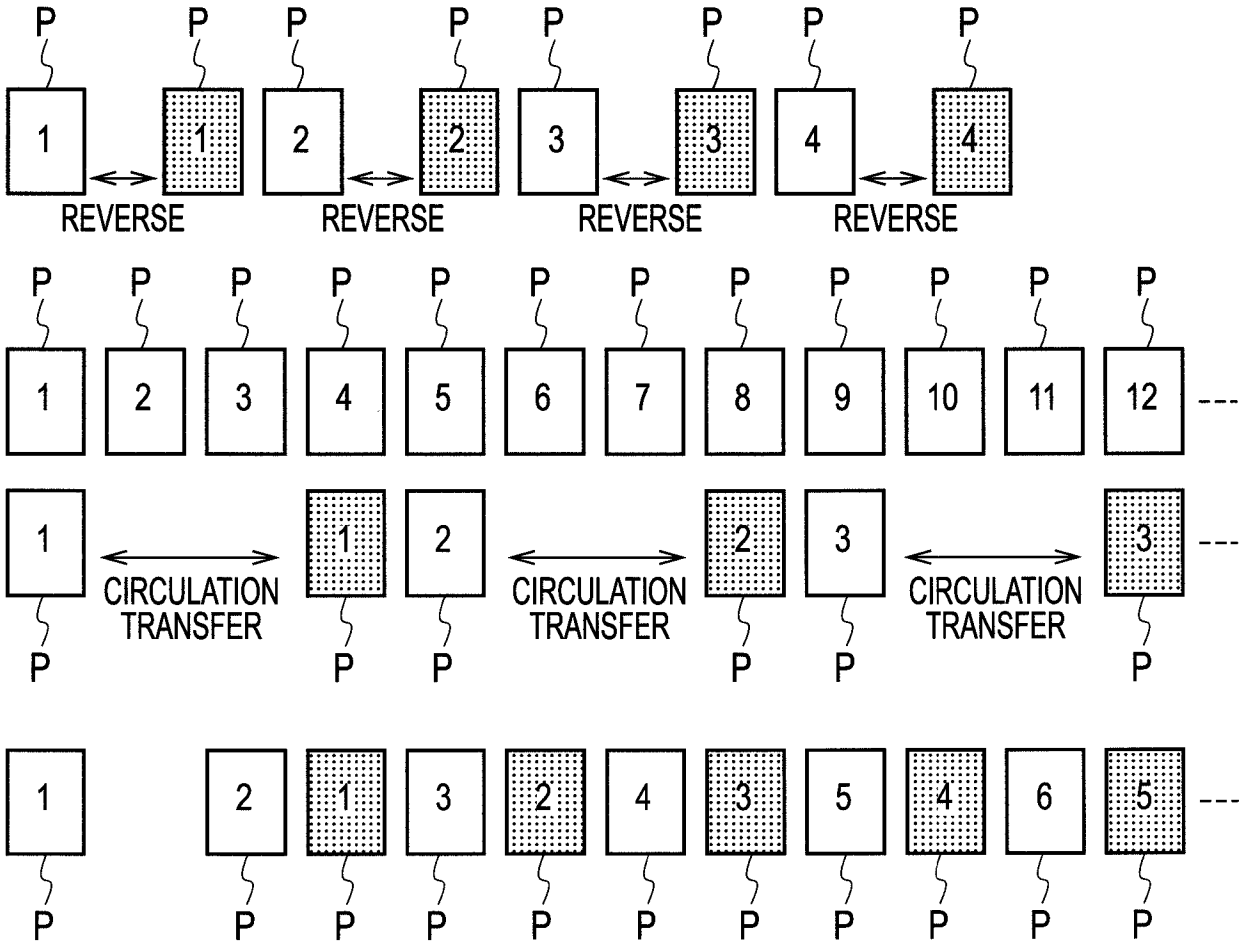
FIGS. 5A to 5D are views for explaining the print schedule during both-side printing.

FIG. 5A shows a pattern, in which the front side of the first sheet P is printed and the first sheet P is reversed, and the rear side of the first sheet P is printed, and then similarly, the front and back sides of the sheet P are continuously printed one by one.

Here, in order to reverse the sheet P in the printing device 1, circulation transfer must be performed, in which the sheet P is returned to the regular path RC via the reverse path RR from the regular path RC. This takes a certain amount of time. For this reason, in the printing device 1, if both-side printing is performed in the pattern of FIG. 5A, the time between the front-side printing and the back-side printing will increase. For example, even if the printing device 1 has a performance capable of continuously printing as shown in FIG. 5B during one-side printing, if the circulation transfer takes time corresponding to printing time for approximately two pages, then as shown in FIG. 5C, the back-side printing will be performed with time corresponding to printing time for two pages taken after the front-side printing. This results in a significant drop in the throughput of print processing.

Then, as shown in FIG. 5D, the printing device 1 of the embodiment prints the front side of the first sheet P, and then prints the front side of the second sheet with time interval corresponding to printing time for one page, and next performs the back-side printing of the first sheet P that is circularly transferred and refed. Then, the printing device 1 immediately prints the front side of the third sheet P, and subsequently performs the back-side printing of the second sheet P that is transferred and refed. By performing such a control, the printing device 1 can perform, in the front-side printing of the second sheet P, and then printing of one side in both-side printing at the same throughput as that during one-side printing.

Returning to FIG. 3, after the print scheduling for determining the printing order and the like of the front and back sides of each sheet as described above is complete, in Step 40 the controller 10 performs both-side printing according to the print schedule.

First, the both-side printing for one sheet is explained. The controller 10 causes the sheet feed driving unit 27 to rotatably drive the external sheet feed roller 22 and transfer a sheet, and stop the external sheet feed roller 22 when a desired amount of sag is formed in the sheet abutted against the registration roller 31. Then, after stopping the external sheet feed roller 22, the controller 10 causes the driving of the registration roller 31 to start at a predetermined timing and feed the sheet toward the belt transfer unit 32.

The controller 10 causes the inkjet head unit 33 to print an image onto the front side of a sheet, which is fed from the registration roller 31, while causing the belt transfer unit 32 to transfer the sheet at a predetermined speed. Subsequently, the controller 10 causes the upper surface transfer roller 41 to transfer the one-side printed sheet through the regular path RC, and causes the switch unit 42 to guide the sheet to the reverse path RR and causes the sheet refeed section 6 to reverse the front and back sides of the sheet. Next, the controller 10 causes the sheet refeed roller 63 to transfer the sheet toward the registration roller 31 again. Here, the controller 10 controls the sheet refeed driving unit 66 so as to stop the sheet refeed roller 63 when a desired amount of sag is formed in the sheet abutting against the registration roller 31.

After stopping the sheet refeed roller 63, the controller 10 causes the driving of the registration roller 31 to start at a predetermined timing and feed the sheet toward the belt transfer unit 32. Then, the controller 10 causes the inkjet head unit 33 to print an image onto the back side that is an un-printed surface of the sheet. Subsequently, the controller 10 causes the sheet discharge section 5 to discharge the both-side printed sheet As described above, in such both-side printing, it takes a certain amount of time between the front-side printing and back-side printing for one sheet. Then, in the embodiment, the printing device 1 performs both-side printing according to the print schedule described in FIG. 5D.

Figure 6:
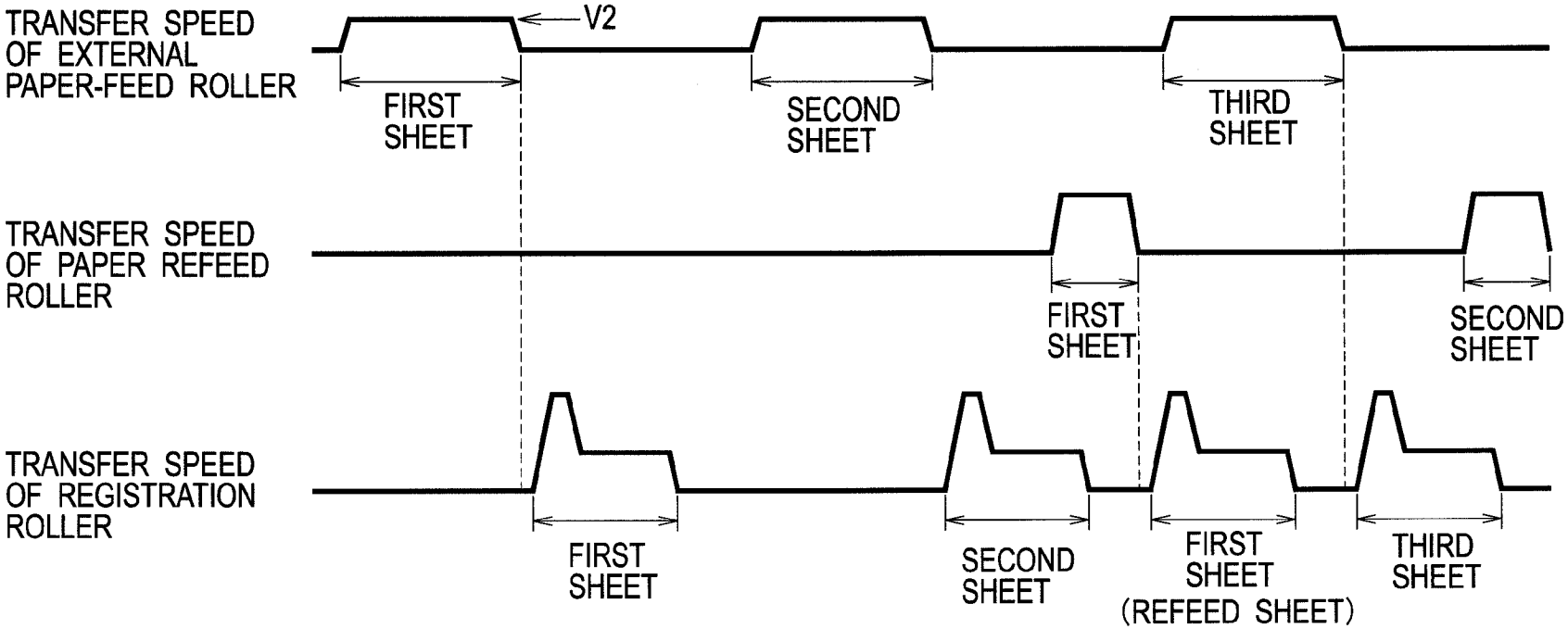
FIG. 6 is a view showing an example of a timing chart showing the transition of a transfer speed in the external sheet feed roller, a sheet refeed roller, and the registration roller during both-side printing.

An example of the timing chart showing the transition of the transfer speed in the external sheet feed roller 22, the sheet refeed roller 63, and the registration roller 31 in this case is shown in FIG. 6. In the embodiment, between the first feed (the sheet feed from the external sheet feed stand 21) of the first sheet and the refeed thereof, the first feed of the second sheet is performed. The first feed of the second sheet is performed with sheet feed timing for one page taken after the first feed of the first sheet. Between the first feed of the second sheet and the refeed thereof, the refeed of the first sheet and the first feed of the third sheet are performed. Then, similarly, the sheet feed and the sheet refeed are performed the same number of times as the number of sheets to be printed. By such sheet feed and sheet refeed, the printing is performed in the order shown in FIG. 5D.

Here, in FIG. 6, the drive timing of the registration roller 31 is the same as that during one-side printing shown in FIG. 4, in the first feed of the second sheet and thereafter. Thus, the printing of one side is performed at the same throughput as that during one-side printing. As shown in FIG. 6, the controller 10 controls so as to feed a sheet, which is fed by the external sheet feed roller 22 and the sheet refeed roller 63, from the registration roller 31 at a timing according to the print schedule.

In both-side printing, the external sheet feed roller 22, as shown in FIG. 6, is accelerated to a transfer speed V2 and is then decelerated and stopped. The sheet is abutted against the registration roller 31 while the external sheet feed roller 22 is being driven at the transfer speed V2. The transfer speed V2 is lower than the transfer speed V1 of the external sheet feed roller 22 during one-side printing shown in FIG. 4.

In order to form a predetermined amount of sag when a sheet is abutted against the registration roller 31, the transfer quantity of sheets by the external sheet feed roller 22 is set substantially the same between during one-side printing and during both-side printing. That is, the drive time of the external sheet feed roller 22 is longer during both-side printing than during one-side printing. During both-side printing, the number of times of sheet feed from the external sheet feed stand 21 is a half the number of times of sheet feed during one-side printing in which the same number of pages are printed. For this reason, during both-side printing, a sheet feed time interval from the external sheet feed stand 21 becomes longer than that during one-side printing. Therefore, during both-side printing, the transfer speed can be reduced by increasing the drive time of the external sheet feed roller 22 without changing the print speed with respect to that during one-side printing. The transfer speed V2 can be reduced within a range allowed for the registration roller 31 to drive at a timing according to the print schedule.

As described above, in the printing device 1 of the embodiment, in both-side printing, while following the print schedule, the sheet speed when a sheet supplied from the external sheet feed stand 21 is abutted against the registration roller 31 is set lower than that during one-side printing. Thus, the printing device 1 can reduce the hitting sound of a sheet against the registration roller 31 and reduce noise. In addition, by reducing the sheet transfer speed of the external sheet feed roller 22, a sound (sheet transfer sound) generated by a sheet that is transferred in the sheet feed path RS can be also reduced. The sheet transfer sound includes a sound generated by a sheet hitting or rubbing against a guide plate (not shown) for guiding a sheet.

On the other hand, the printing device 1, even during both-side printing, can perform each-side printing at the same throughput as that during one-side printing, and maintains the productivity.

In this manner, according to the printing device 1 of the embodiment, the noise can be reduced while productivity is maintained.

This embodiment is described as a case that sheets are fed from the external sheet feed stand 21. However, when sheets are fed from the internal sheet feed stand 23 during both-side printing, the controller 10 may drive the vertical transfer roller 26 as with the driving of the external sheet feed roller 22 described in FIG. 6. That is, the controller 10 controls so that the transfer speed of the vertical transfer roller 26 becomes lower during both-side printing than during one-side printing.

Here, the controller 10 drives the internal sheet feed roller 24 and the internal sheet feed and transfer roller 25 and conveys a sheet toward the vertical transfer roller 26 in concert with the driving of the vertical transfer roller 26. In this case, the controller 10 also sets the transfer speed of the internal sheet feed and transfer roller 25 lower than that during one-side printing, as with the vertical transfer roller 26. Thus, the sheet transfer speed in the entire transfer path from the internal sheet feed stand 23 to the registration roller 31 becomes lower during both-side printing than during one-side printing. Thus, the driving sound of the motor of the sheet feed driving unit 27 driving the internal sheet feed and transfer roller 25 and the vertical transfer roller 26 can be reduced. Moreover, the sheet transfer sound can be also reduced. As a result, the noise generated by the printing device 1 can be further reduced.

Moreover, the controller 10, in both-side printing, controls the sheet transfer speed by the external sheet feed roller 22, the internal sheet feed and transfer roller 25, and the vertical transfer roller 26 in feeding a sheet from the external sheet feed stand 21 and each internal sheet feed stand 23, according to the length of the transfer path from the external sheet feed stand 21 and each internal sheet feed stand 23 to the registration roller 31.

For example, the uppermost internal-sheet feed stand 23 has a shorter transfer path to the registration roller 31 than the other internal sheet feed stands 23. For this reason, the controller 10 sets the sheet transfer speed, by the internal sheet feed and transfer roller 25 and the vertical transfer roller 26, when a sheet is fed from the uppermost internal-sheet feed stand 23 lower than when a sheet is fed from the other internal sheet feed stands 23. Thus, the drive sound of the motor and the sheet transfer sound of the sheet feed driving unit 27 can be more effectively reduced.

The present application claims the benefit of priority under 35 U.S.C. §119 to Japanese Patent Application No. 2010-285474, filed on Dec. 22, 2010, the entire content of which is incorporated herein by reference.

What is claimed is:

1. A printing device, comprising:

a registration section that once stops a transferred sheet and then feeds the transferred sheet toward a printing section;

a sheet feed system that transfers and feeds a sheet to the registration section;

a sheet refeed system that, during both-side printing, reverses a one-side printed sheet and transfers the one-side printed sheet to the registration section to refeed the one-side printed sheet; and a controller that, during one-sided printing, controls the registration section so as to feed a sheet, which is fed by the sheet feed system, toward the printing section in accordance with a first print schedule, and during both-side printing, controls the registration section so as to feed a sheet, which is fed by the sheet feed system, toward the printing section until a predetermined timing and after the predetermined timing alternately feed a sheet, which is fed by the sheet feed system and the sheet refeed system, toward the printing section in accordance with a second print schedule, wherein the controller controls the sheet feed system, during the one-sided printing, in accordance with the first print schedule to set a speed when a sheet fed from the sheet feed system is transferred to the registration section as a first speed and during the both-sided printing, in accordance with the second print schedule to set a speed when a sheet fed from the sheet feed system is transferred to the registration section as a second speed, wherein the second speed is lower than the first speed.

2. The printing device according to claim 1, wherein the sheet feed system includes a sheet feeder in which a sheet is stacked, and wherein the controller controls the sheet feed system so that a sheet transfer speed in an entire transfer path from the sheet feeder to the registration section becomes lower during both-side printing than during one-side printing.

3. The printing device according to claim 2, wherein the sheet feeder includes a plurality of sheet feed stands, and wherein the controller, during both-side printing, controls a sheet transfer speed for the sheet feed system according to a length of a transfer path from each sheet feed stand to the registration section.

4. The printing device according to claim 1, wherein the controller controls the sheet feed system and the sheet refeed system so that a sheet transfer amount to the registration section during the one-side printing in accordance with the first print schedule is the same as a sheet transfer amount to the registration section during the both-sided printing in accordance with the second print schedule within a predetermined period of time.

* * * * *